US010925452B2

(12) United States Patent
Hyun et al.

(10) Patent No.: US 10,925,452 B2
(45) Date of Patent: Feb. 23, 2021

(54) DUST COLLECTOR FOR VACUUM CLEANER

(71) Applicant: LG ELECTRONICS INC., Seoul (KR)

(72) Inventors: Kietak Hyun, Seoul (KR); Seungyeop Lee, Seoul (KR); Hyukjin Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

(21) Appl. No.: 15/524,584

(22) PCT Filed: Nov. 20, 2015

(86) PCT No.: PCT/KR2015/012546
§ 371 (c)(1),
(2) Date: May 4, 2017

(87) PCT Pub. No.: WO2016/099040
PCT Pub. Date: Jun. 23, 2016

(65) Prior Publication Data

US 2018/0279846 A1 Oct. 4, 2018

(30) Foreign Application Priority Data

Dec. 17, 2014 (KR) ..... 10-2014-0182626

(51) Int. Cl.
*A47L 9/16* (2006.01)
*A47L 9/10* (2006.01)
(Continued)

(52) U.S. Cl.
CPC ..... *A47L 9/1616* (2013.01); *A47L 9/108* (2013.01); *A47L 9/165* (2013.01); *A47L 9/1608* (2013.01);
(Continued)

(58) Field of Classification Search
CPC ..... A47L 9/1616; A47L 9/16; A47L 9/1608; A47L 9/1625; A47L 9/1641;
(Continued)

(56) References Cited

U.S. PATENT DOCUMENTS 7,065,826 B1 6/2006 Arnold
7,874,040 B2 * 1/2011 Follows ..... A47L 9/1616 15/347
(Continued)

FOREIGN PATENT DOCUMENTS

CN 202537412 U 11/2012
DE 202004020613 * 10/2005 ..... A47L 9/16
(Continued)

OTHER PUBLICATIONS

Machine Translation of DE202004020613 (Year: 2005).*
(Continued)

*Primary Examiner* — Brian D Keller
*Assistant Examiner* — Robert F Neibaur
(74) *Attorney, Agent, or Firm* — KED & Associates, LLP

(57) ABSTRACT

The present disclosure discloses a dust collector for a vacuum cleaner including a first cyclone installed within an outer case to filter out dust from air inhaled from an outside thereof and introduce the air from which dust has been filtered out into an inside thereof, a plurality of second cyclones accommodated in the inside of the first cyclone to separate fine dust from the air introduced to the inside of the first cyclone, and a cover member disposed to cover an inlet of the second cyclone, wherein cyclones disposed adjacent to each other among the first and the second cyclones limit a first space within the first cyclone, and the cover member forms a second space communicating with the first space between the inlet and the cover member, and a guide vane extended in a spiral shape along an inner circumference
(Continued)

thereof is provided at the inlet to induce rotational flow in air introduced to an inside of the second cyclone through the first and the second space.

20 Claims, 6 Drawing Sheets

(51) Int. Cl.
*B04C 5/28* (2006.01)
*B04C 5/06* (2006.01)
*B04C 5/26* (2006.01)

(52) U.S. Cl.
CPC ..... *A47L 9/1633* (2013.01); *A47L 9/1641* (2013.01); *A47L 9/1683* (2013.01); *B04C 5/06* (2013.01); *B04C 5/26* (2013.01); *B04C 5/28* (2013.01)

(58) Field of Classification Search
CPC ..... A47L 9/1658; A47L 9/1683; A47L 9/108; A47L 9/1633; A47L 9/165; B04C 5/15; B04C 5/26
USPC ..... 15/353
See application file for complete search history.

(56) References Cited

U.S. PATENT DOCUMENTS

| | | | | |
|---|---|---|---|---|
| 7,892,305 | B2 * | 2/2011 | Hyun | A47L 9/1616 15/352 |
| 7,976,597 | B2 * | 7/2011 | Smith | A47L 9/1625 15/352 |
| 8,657,910 | B2 * | 2/2014 | Park | A47L 9/1683 55/337 |
| 8,881,343 | B2 * | 11/2014 | Park | A47L 9/0081 15/353 |
| 8,914,941 | B2 * | 12/2014 | Kim | A47L 9/1641 15/353 |
| 9,005,325 | B2 * | 4/2015 | Smith | A47L 9/1608 55/345 |
| 9,161,668 | B2 * | 10/2015 | Quance | A47L 9/127 |
| 9,211,046 | B2 * | 12/2015 | Peace | A47L 9/1633 |
| 10,130,226 | B2 * | 11/2018 | Shin | A47L 9/108 |
| 2006/0254226 | A1 * | 11/2006 | Jeon | A47L 9/1625 55/345 |
| 2008/0155947 | A1 | 7/2008 | Oh et al. | |
| 2008/0223010 | A1 | 9/2008 | Han et al. | |
| 2009/0113861 | A1 | 5/2009 | Seo et al. | |
| 2009/0199359 | A1 | 8/2009 | Hyun et al. | |
| 2009/0300871 | A1 | 12/2009 | Seo et al. | |
| 2010/0263161 | A1 * | 10/2010 | Lee | A47L 5/362 15/347 |
| 2012/0180253 | A1 | 7/2012 | Hwang et al. | |

FOREIGN PATENT DOCUMENTS

| | | |
|---|---|---|
| EP | 2 055 220 | 5/2009 |
| JP | 2003-524522 | 8/2003 |
| JP | 2007-521939 | 8/2007 |
| JP | 2011-224189 | 11/2011 |
| JP | 2013-039519 | 2/2013 |
| JP | 2014-171668 | 9/2014 |
| WO | WO 2009/104959 | 8/2009 |

OTHER PUBLICATIONS

Japanese Office Action dated May 8, 2018 issued in Application No. 2017-528797.
Partial Supplementary European Search Report dated Jul. 20, 2018 issued in Application No. 15870208.4.
International Search Report and Written Opinion dated Apr. 11, 2016 issued in Application No. PCT/KR2015/012546 (Full English Text).
Korean Office Action dated Feb. 20, 2020 issued in KR Application No. 10-2014-0182626.
Korean Office Action dated Aug. 14, 2020 issued in KR Application No. 10-2014-0182626.

* cited by examiner

[Fig. 1]
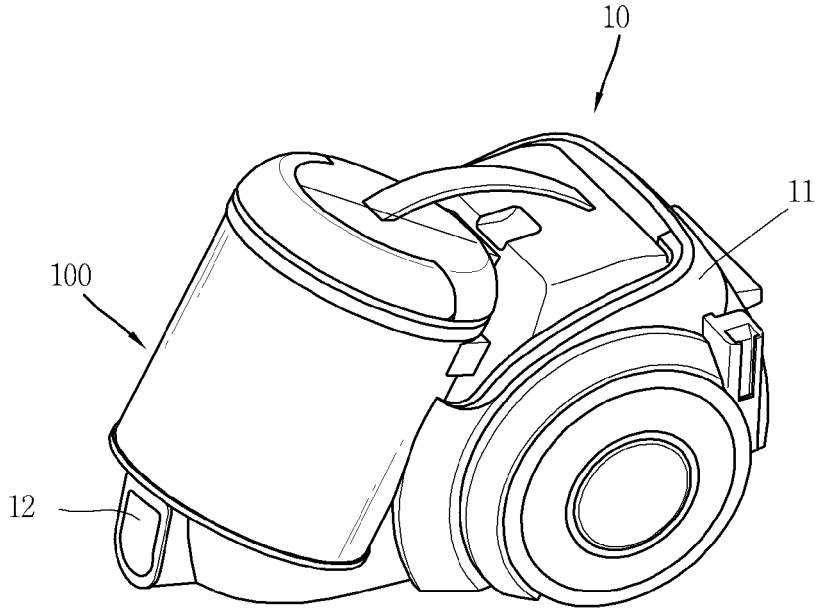

[Fig. 2]
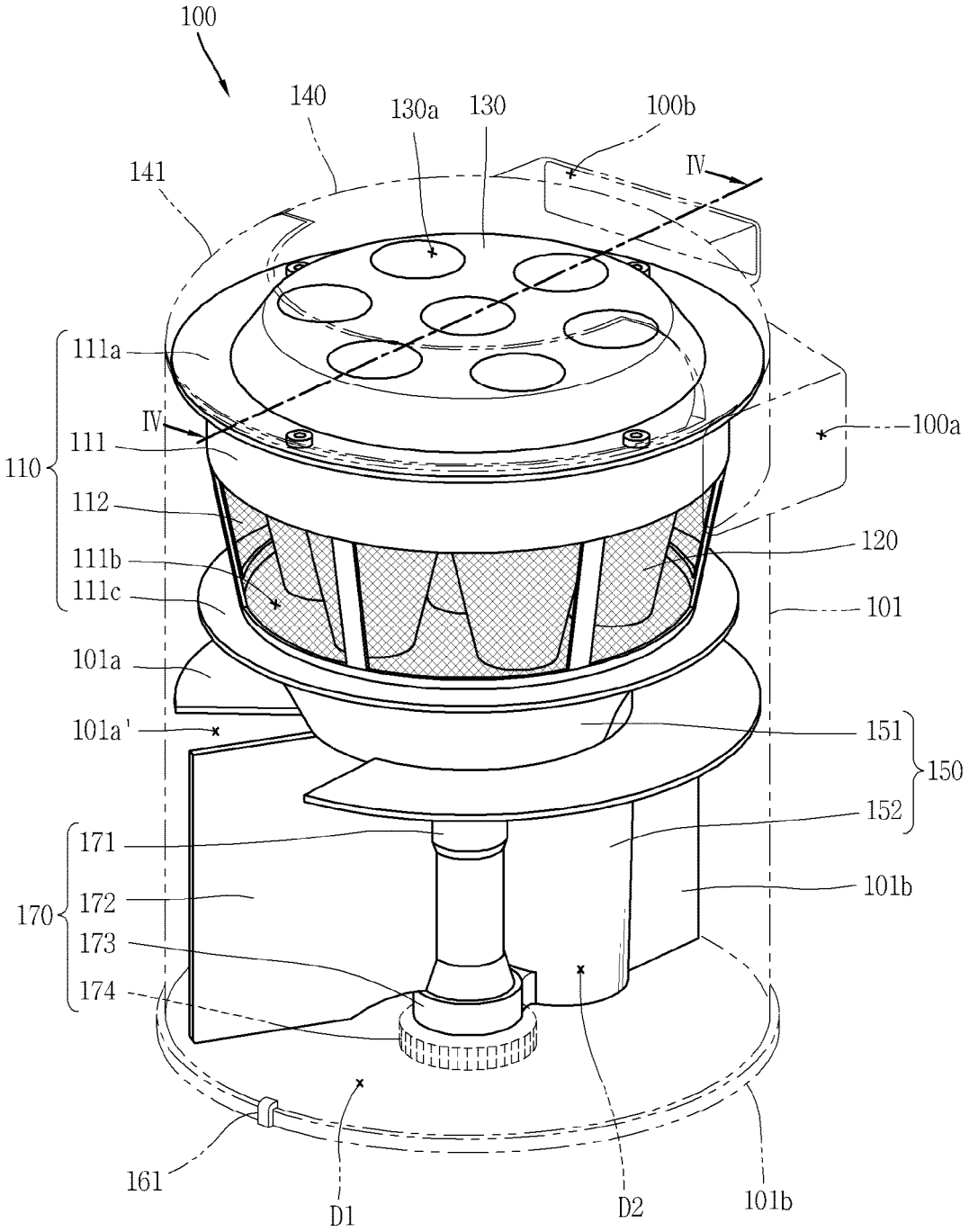

[Fig. 3]
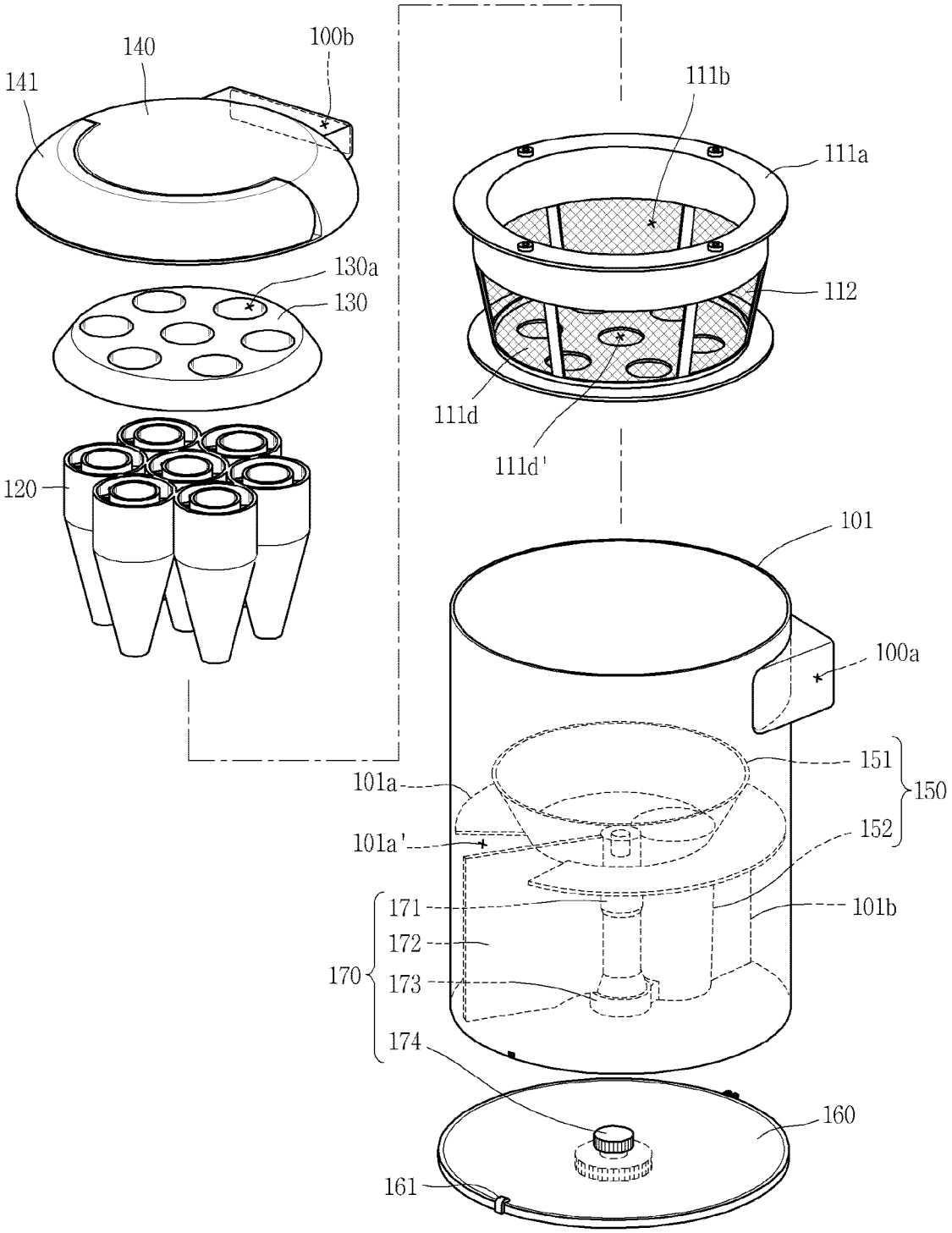

[Fig. 4]
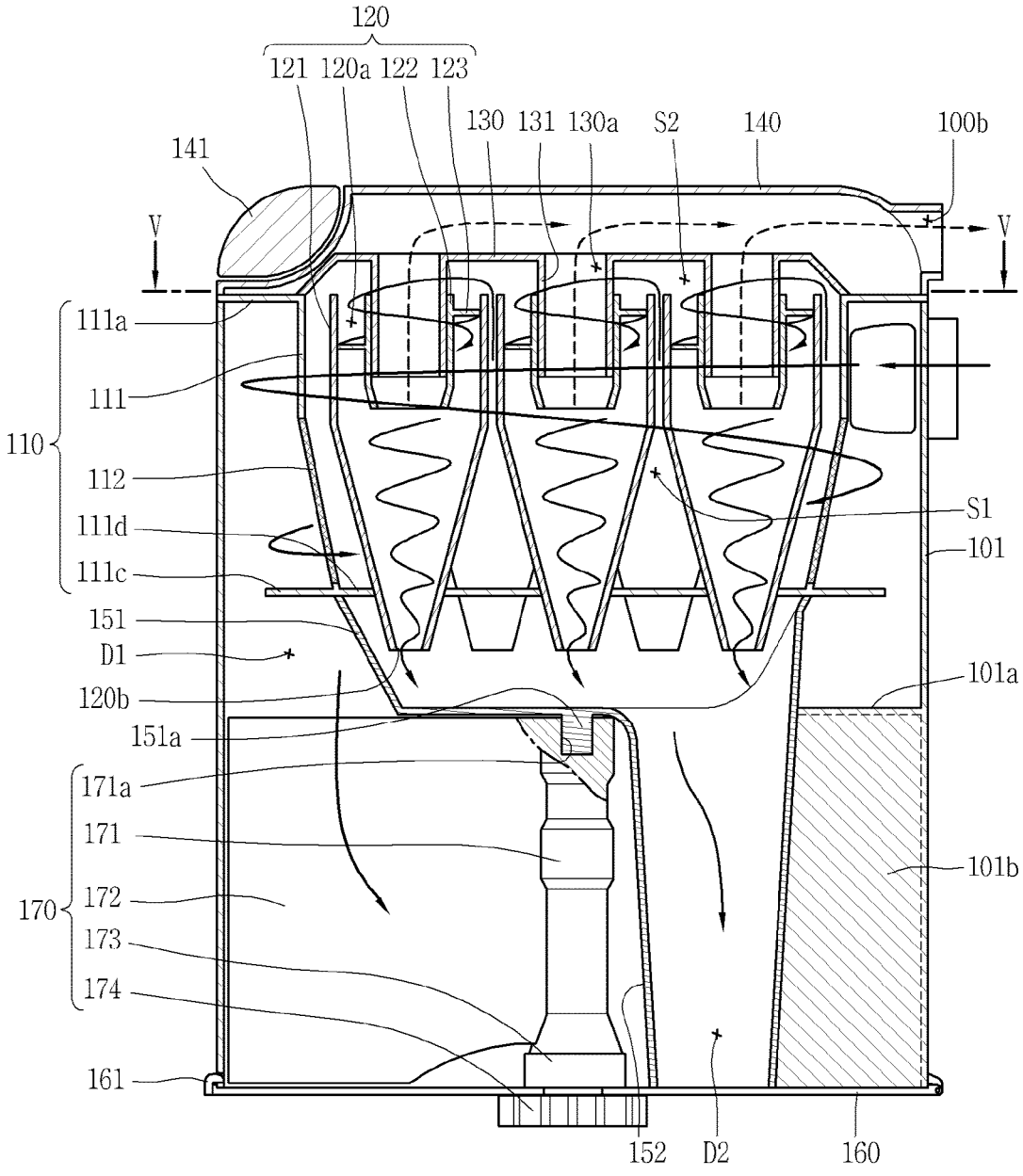

[Fig. 5]
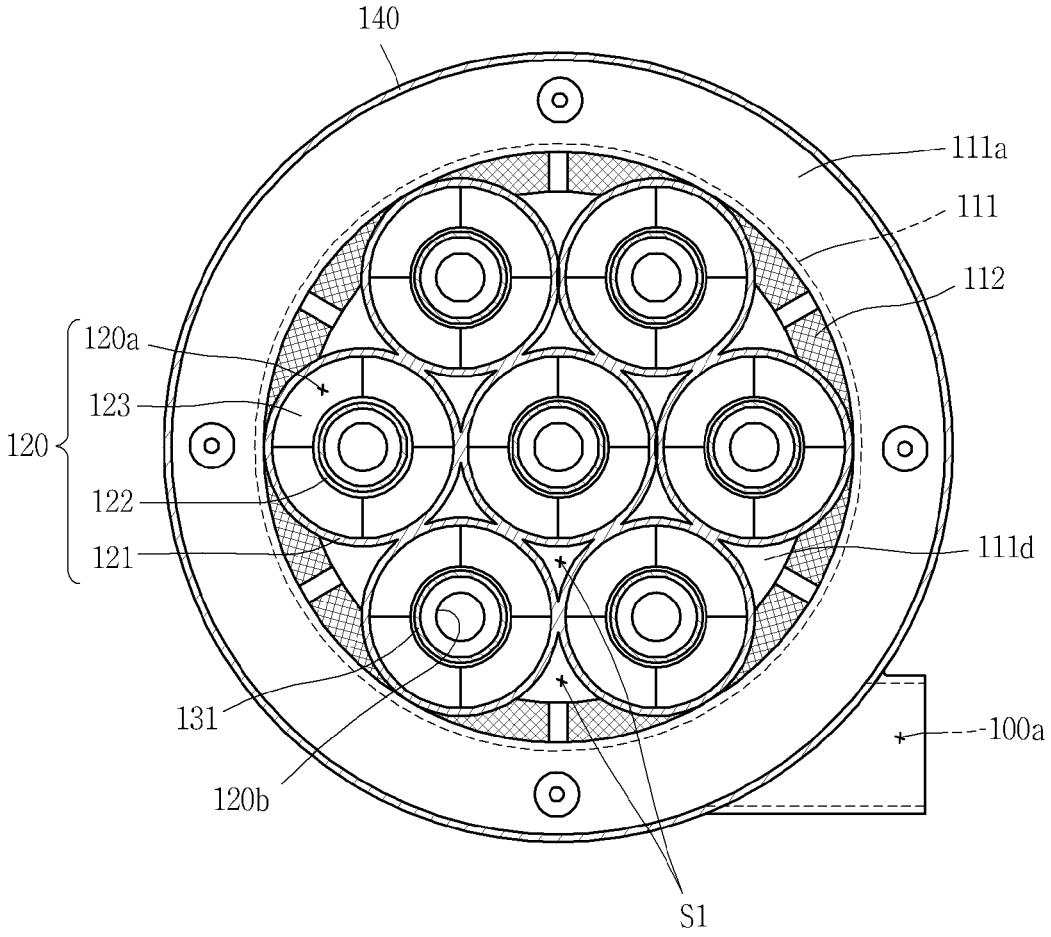

[Fig. 6]
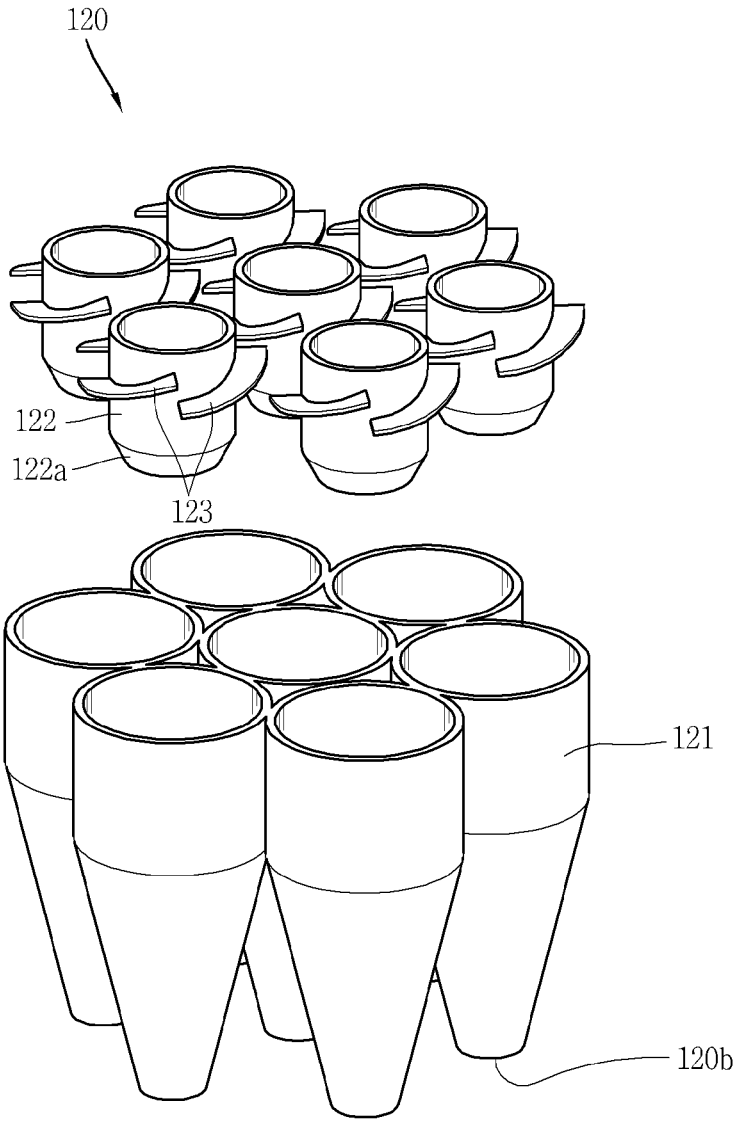

DUST COLLECTOR FOR VACUUM CLEANER

CROSS-REFERENCE TO RELATED PATENT APPLICATIONS

This application is a U.S. National Stage Application under 35 U.S.C. § 371 of PCT Application No. PCT/KR2015/012546, filed Nov. 20, 2015, which claims priority to Korean Patent Application No. 10-2014-0182626, filed Dec. 15, 2014, whose entire disclosures are hereby incorporated by reference.

TECHNICAL FIELD

The present disclosure relates to a dust collector for a vacuum cleaner configured to collect dust and fine dust in a separate manner through a multi-cyclone.

BACKGROUND ART

A vacuum cleaner is an apparatus configured to inhale air using suction power and separate dust or dirt from the air to discharge clean air.

The types of vacuum cleaners may be divided into i) a canister type, ii) an upright type, iii) a hand type, iv) a cylindrical floor type, and the like.

In recent years, the canister type vacuum cleaner is a vacuum cleaner mostly used at home, which is a vacuum cleaner with a method of communicating a suction nozzle with a cleaner body through a connecting member. The canister type is suitable to clean a solid floor due to performing cleaning only with suction power.

On the contrary, the upright type vacuum cleaner is a vacuum cleaner in which a suction nozzle and a cleaner body are integrally shaped. The upright type vacuum cleaner may include a rotary brush, and thus clean up even dust or the like within a carpet, contrary to the canister type vacuum cleaner.

However, vacuum cleaners in the related art have various drawbacks as follows.

First, for vacuum cleaners having a multi-cyclone structure, each cyclone is vertically disposed to cause a problem of increasing the height of a dust collector thereof. Furthermore, the dust collector is designed to have a slim profile to solve such a volume increase issue, thereby causing a disadvantage of reducing the volume of a space for collecting actual dust.

In order to solve the foregoing problem, a structure in which a second cyclone is disposed within a first cyclone has been proposed, but it is difficult to efficiently dispose the second cyclone within the first cyclone due to interference between the guide passages of the second cyclone. Even when the second cyclone is disposed within the first cyclone, the number of second cyclones is significantly decreased to reduce suction power, thereby resulting in the deterioration of cleaning performance.

Furthermore, for cleaners in the related art, there exists a limit in providing the user's convenience even during the dust discharge process. There are vacuum cleaners in which dust is blown away during the process of discharging the dust, and also exist vacuum cleaners requiring a very complicated process to discharge dust.

DISCLOSURE OF INVENTION

Technical Problem

An aspect of the present disclosure is to provide a dust collector for a vacuum cleaner with a new structure in which a multi-cyclone structure is enhanced to lower down the height without reducing the cleaning performance.

Furthermore, another aspect of the present disclosure is to propose a dust collector capable of collecting dust and fine dust in a separate manner, and discharging the collected dust and fine dust at the same time.

Moreover, still another aspect of the present disclosure is to provide a dust collector capable of compressing dust to facilitate the discharge of dust.

Solution to Problem

In order to solve the foregoing tasks of the present disclosure, a dust collector for a vacuum cleaner may include a first cyclone installed within an outer case to filter out dust from air inhaled from an outside thereof and introduce the air from which dust has been filtered out into an inside thereof; a plurality of second cyclones accommodated in the inside of the first cyclone to separate fine dust from the air introduced to the inside of the first cyclone; and a cover member disposed to cover an inlet of the second cyclone, wherein cyclones disposed adjacent to each other among the first and the second cyclones limit a first space within the first cyclone, and the cover member forms a second space communicating with the first space between the inlet and the cover member, and a guide vane extended in a spiral shape along an inner circumference thereof is provided at the inlet to induce rotational flow in air introduced to an inside of the second cyclone through the first and the second space.

According to an example associated with the present disclosure, cyclones disposed adjacent to each other among the second cyclones may be disposed to be in contact with each other.

The second cyclones may be formed such that cyclones disposed adjacent to each other are connected to each other to form an integral body.

Cyclones arranged along an inner circumference of the first cyclone among the second cyclones may be disposed to be in contact with an inner circumferential surface of the first cyclone.

According to another example associated with the present disclosure, a vortex finder for discharging air from which fine dust has been separated may be provided at the center of the second cyclone, and the guide vane may be installed on the inlet limited between an inner circumference of the second cyclone and an outer circumference of the vortex finder.

The guide vane may be disposed within the first cyclone.

A plurality of guide vanes may be disposed at predetermined intervals in a separate manner along an outer circumference of the vortex finder.

A lower diameter of the vortex finder may be smaller than an upper diameter of the vortex finder to limit fine dust introduced to the inside of the second cyclone from being discharged through the vortex finder.

The cover member may include a communication hole corresponding to the vortex finder, and an upper cover may be disposed on the cover member to form a discharge passage so as to discharge air discharged through the communication hole to an outside of the dust collector.

A protrusion portion inserted into the vortex finder and provided with the communication hole therein may be formed on the cover member.

According to still another example associated with the present disclosure, an outlet of the second cyclone may be installed to pass through a bottom surface of the first cyclone, and an inner case for accommodating the outlet may be installed at a lower portion of the first cyclone to form a fine dust storage portion for collecting fine dust discharged through the outlet.

Dust filtered out through the first cyclone may be collected into a dust storage portion between an inner circumference of the outer case and an outer circumference of the inner case.

The dust collector for a vacuum cleaner may further include a lower cover hinge-coupled to the outer case to form a bottom surface of the dust storage portion and the fine dust storage portion, and rotated by the hinge to open the dust storage portion and the fine dust storage portion at the same time so as to discharge the dust and the fine dust at the same time.

A skirt may be formed in a protruding manner at a lower portion of the first cyclone along an outer circumferential surface to prevent the scattering of dust collected into the dust storage portion.

A partition plate at one portion of which is open may be installed between the outer case and the inner case to form an upper wall of the dust storage portion and introduce dust filtered out by the first cyclone to a predetermined region of the dust storage portion.

The dust collector for a vacuum cleaner may further include a pressurizing unit configured to be rotatable in both directions within the dust storage portion so as to pressurize dust collected in the dust storage portion to reduce the volume.

The pressurizing unit may include a rotating shaft; a pressurizing member connected to the rotating shaft to be rotatable within the dust storage portion; and a stationary portion formed to be relatively rotatable with respect to the rotating shaft, and coupled to the inner case.

A lower end portion of the pressuring unit may be configured to be engaged with a driving gear of a cleaner body when the dust collector is coupled to the cleaner body through the lower cover to be exposed to an outside of the dust collector.

The inner case may include a first portion formed to accommodate the outlet and disposed on the rotating shaft, and a second portion extended to one side of the first portion and disposed in parallel with one side of the rotating shaft.

A groove recessed in an inward direction may be formed at an upper portion of the rotating shaft, and a protrusion inserted into the groove to support the rotation of the rotating shaft may be formed in a protruding manner at a lower portion of the first portion.

Moreover, the present disclosure discloses a dust collector for a vacuum cleaner including an outer case having an entrance; a first cyclone installed at an inside of the outer case, and provided with a mesh filter covering an opening portion communicating with the inside at an outer circumference thereof; a plurality of second cyclones accommodated into the first cyclone, and provided with a vortex finder provided at an inlet side and a guide vane extended in a spiral shape to an outlet side from the inlet side; and a cover member disposed to cover the second cyclone, and provided with a communication hole corresponding to the vortex finder, wherein air introduced from the outside is introduced into the first cyclone in a state that dust is filtered out by the mesh filter, and air introduced into the first cyclone is introduced into the second cyclone in a state that rotational flow is induced by the guide vane to discharge fine dust through the outlet, and discharge air from which fine dust has been filtered out onto the cover member through the vortex finder.

According to an example associated with the present disclosure, an upper cover may be disposed on the cover member to form a discharge passage for discharging air from which fine dust has been filtered out to the outside.

According to another example associated with the present disclosure, an outlet of the second cyclone may be installed to pass through a bottom surface of the first cyclone, and an inner case for accommodating the outlet may be installed at a lower portion of the first cyclone to form a fine dust storage portion for collecting fine dust discharged through the outlet.

Dust filtered out through the first cyclone may be collected into a dust storage portion between an inner circumference of the outer case and an outer circumference of the inner case.

A partition plate at one portion of which is open may be installed between the outer case and the inner case to form an upper wall of the dust storage portion and introduce dust filtered out by the first cyclone to a predetermined region of the dust storage portion.

Advantageous Effects of Invention

According to the present disclosure having the foregoing configuration, a second cyclone may be accommodated into a second cyclone to reduce a height of the dust collector. According to such an arrangement, a guide vane may be installed at an inlet of the second cyclone to induce rotational flow in air introduced into the second cyclone, and thus an additional guide passage extended from one side of the second cyclone may not be required, thereby allowing a larger number of second cyclones to be disposed within the first cyclone. Accordingly, it may be possible to prevent the degradation of cleaning performance due to the arrangement.

Furthermore, according to the present disclosure, a dust storage portion and a fine dust storage portion may be configured to be open at the same time during the separation of a lower cover, thereby discharging dust collected in the dust storage portion and fine dust collected in the fine dust storage portion at the same time.

Furthermore, according to the present disclosure, dust collected by a pressurizing unit may be collected, thereby preventing the scattering of the collected dust.

BRIEF DESCRIPTION OF DRAWINGS

FIG. 1 is a perspective view illustrating a vacuum cleaner according to the present disclosure.

FIG. 2 is a conceptual view illustrating a dust collector illustrated in FIG. 1.

FIG. 3 is a conceptual view in which the internal major configurations of a dust collector illustrated in FIG. 2 are shown in a separate manner.

FIG. 4 is a longitudinal cross-sectional view in which the dust collector of FIG. 2 is seen along line IV-IV.

FIG. 5 is a longitudinal cross-sectional view in which the dust collector of FIG. 4 is seen along line V-V.

FIG. 6 is a conceptual view in which a second cyclone illustrated in FIG. 3 is shown in a separate manner.

MODE FOR THE INVENTION

Hereinafter, a dust collector for a vacuum cleaner associated with the present disclosure will be described in more detail with reference to the accompanying drawings.

Even in different embodiments according to the present disclosure, the same or similar reference numerals are designated to the same or similar configurations, and the redundant description thereof will be omitted.

Unless clearly used otherwise, expressions in the singular number used in the present disclosure may include a plural meaning.

In describing the present disclosure, moreover, the detailed description will be omitted when a specific description for publicly known technologies to which the invention pertains is judged to obscure the gist of the present invention.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

FIG. 1 is a perspective view illustrating a vacuum cleaner 10 according to the present disclosure.

Referring to FIG. 1, the vacuum cleaner 10 may include a cleaner body 11 having a fan portion (not shown) configured to generate suction power. The fan portion may include a suction motor and a suction fan rotated by the suction motor to generate suction power.

Though not shown in the drawing, the vacuum cleaner 10 may further include a suction nozzle (not shown) configured to inhale air containing foreign substances and a connecting member (not shown) configured to connect the suction nozzle to the cleaner body 11. According to the present disclosure, the basic configuration of the suction nozzle and the connecting member is the same as in the related art, and thus the description thereof will be omitted.

A suction portion 12 configured to suck air inhaled through the suction nozzle and foreign substances contained in the air is formed at a front lower portion of the cleaner body 11. The air and foreign substances are introduced into the suction portion 12 by the operation of the fan portion. The air and foreign substances introduced to the suction portion 12 are introduced into the dust collector 100, and separated from each other in the dust collector 100.

The dust collector 100 is configured to collect foreign substances from the inhaled air in a separate manner, and discharge air from which dust has been separated. The dust collector 100 is configured to be mountable on the cleaner body 11. Hereinafter, the dust collector 100 according to the present disclosure will be described in detail.

FIGS. 2 through 4 illustrate the entire configuration of the dust collector 100 and the flow of air and foreign substances within the dust collector 100. FIG. 2 is a conceptual view illustrating the dust collector 100 illustrated in FIG. 1, and FIG. 3 is a conceptual view in which the internal major configurations of the dust collector 100 illustrated in FIG. 2 are shown in a separate manner, and FIG. 4 is a longitudinal cross-sectional view in which the dust collector 100 of FIG. 2 is seen along line IV-IV.

The detailed structure associated with the features of the present disclosure will be described with reference to FIGS. 5 and 6. FIG. 5 is a longitudinal cross-sectional view in which the dust collector 100 of FIG. 4 is seen along line V-V, and FIG. 6 is a conceptual view in which a second cyclone 120 illustrated in FIG. 3 is shown in a separate manner.

For reference, the present drawings illustrate the dust collector 100 applied to a canister type vacuum cleaner 10, but the dust collector 100 according to the present disclosure may not be necessarily limited to the canister type vacuum cleaner 10. The dust collector 100 according to the present disclosure may be also applicable to an upright type vacuum cleaner 10.

Air and foreign substances are introduced to an entrance 100*a* of the dust collector 100 through the suction portion 12 by suction power generated by the fan portion of the vacuum cleaner 10. The air introduced to the entrance 100*a* is sequentially filtered at the first cyclone 110 and second cyclone 120 while flowing along a passage, and discharged through an exit 100*b*. Dust and fine dust separated from the air are collected into the dust collector 100.

A cyclone refers to an apparatus for providing rotational flow to fluid in which particles are floating to separate particles from the fluid by a centrifugal force. The cyclone separates foreign substances such as dust, fine dust, and the like from air introduced to an inside of the cleaner body 11 by suction power. According to the present specification, relatively large substances are referred to as "dust", and relatively small substances are referred to as "fine dust", and dust smaller than "fine dust" is referred to as "ultra-fine dust."

The dust collector 100 may include an outer case 101, a first cyclone 110, a second cyclone 120 and a cover member 130.

The outer case 101 forms a lateral appearance of the dust collector 100. The case 101 may be preferably formed in a cylindrical shape as illustrated in the drawing, but may not be necessarily limited to this.

The entrance 100*a* of the dust collector 100 is formed on the outer case 101. The entrance 100*a* may be formed to be extended toward an inner circumference of the outer case 101 to allow air and foreign substances to be tangentially introduced into the outer case 101 and revolved along the inner circumference of the outer case 101.

The first cyclone 110 is installed within the outer case 101. The first cyclone 110 may be disposed at an upper portion within the outer case. The first cyclone 110 is configured to filter out dust from air introduced along with foreign substances, and introduce the air from which dust has been filtered out to an inside thereof.

The first cyclone 110 may include a housing 111 and a mesh filter 112.

The housing 111 forms an external appearance of the first cyclone 110, and may be formed in a cylindrical shape similarly to the outer case 101. A support portion 111*a* may be formed in a protruding manner to be coupled to the outer case 101. According to the present embodiment, it is illustrated that the support portion 111*a* is formed in a protruding manner at an upper portion of the housing 111 along an outer circumference thereof, and the support portion 111*a* is coupled to an upper portion of the outer case 101.

The housing 111 is formed in a shape in which an inside thereof is vacant to accommodate the second cyclone 120. An opening portion 111*b* communicating with an inside of the housing 111 is formed on an outer circumference thereof. The opening portion 111*b* may be formed at a plurality of positions along the outer circumference of the housing 111 as illustrated in the drawing.

The mesh filter 112 is installed on the housing 111 to cover the opening portion 111*b*, and has a mesh or porous shape to allow air to pass therethrough. The mesh filter 112 is formed to separate dust from air introduced into the housing 111.

The criteria of separating dust from fine dust may be determined by the mesh filter 112. Foreign substances having a size of being allowed to pass through the mesh filter 112 may be divided into fine dust, and foreign substances having a size of being disallowed to pass through the mesh filter 112 may be divided into dust.

Considering the process of separating dust by the first cyclone 110 in detail, air and foreign substances are introduced into an annular space between the outer case 101 and first cyclone 110 through the entrance 100*a* of the dust collector 100 to rotationally move in the annular space.

During the process, relatively heavy dust gradually flows down while rotationally moving in a spiral shape in a space between the outer case 101 and first cyclone 110 by a centrifugal force. Here, a skirt 111*c* may be formed in a protruding manner at a lower portion of the housing 111 along an outer circumference to prevent the scattering of dust collected in the dust storage portion (D1).

On the other hand, contrary to dust, air is introduced into the housing 111 through the mesh filter 112. Here, fine dust may be also introduced into the housing 111 along with the air.

Referring to FIG. 4, it may be possible to check the internal structure of the dust collector 100 and the flow of air and foreign substances within the dust collector 100.

A plurality of second cyclones 120 are configured to be disposed within the first cyclone 110 to separate air and fine dust introduced into the inside through an inlet 120*a*.

Contrary to an existing vertical arrangement in which the second cyclone is disposed on the first cyclone, the second cyclone 120 of the present disclosure may be accommodated into the first cyclone 110, thereby reducing the height of the dust collector 100. The second cyclone 120 may be formed not to be protruded at an upper portion of the first cyclone 110.

Moreover, the second cyclone in the related art has a guide passage extended from one side thereof to allow air and fine dust to be tangentially introduced thereinside to rotate along an inner circumference of the second cyclone, but the second cyclone 120 of the present disclosure does not have such a guide passage. Accordingly, the second cyclone 120 has a circular shape when viewed from the above.

Referring to both FIGS. 4 and 5, cyclones disposed adjacent to each other among the first and the second cyclones 110, 120 limits a first space (S1). In other words, in a region in which the second cyclone 120 within the first cyclone 110 is disposed, a vacant space excluding the second cyclone 120 may be understood as the first space (S1). The first space (S1) forms a passage capable of allowing air and fine dust that has been introduced into the first cyclone 110 to be introduced to an upper portion of the second cyclone 120.

Each of the second cyclones 120 may be disposed in a vertical direction, and a plurality of second cyclones 120 may be disposed in parallel to each other. According to the arrangement, the first space (S1) may be formed to be extended in a vertical direction within the first cyclone 110.

Cyclones disposed adjacent to each other among the second cyclones 120 may be disposed to be in contact with each other. Specifically, a conically shaped casing 121 may be disposed to be brought into contact with the casing 121 of the adjoining second cyclone 120 to form the first space (S1) surrounded by the casing 121.

As illustrated in the present embodiment, the casing 121 of any one second cyclone 120 may be integrally formed with the casing 121 of the adjoining second cyclone 120. According to the foregoing structure, a plurality of second cyclones 120 are modularized and installed within the first cyclone 110.

Furthermore, cyclones arranged along an inner circumference of the first cyclone 110 among the second cyclones 120 may be disposed to be in contact with an inner circumferential surface of the first cyclone 110. In FIG. 5, it is shown that an inner circumferential surface of the housing 111 and an outer circumferential surface corresponding to a cylindrically shaped portion of the casing 121 are disposed to be brought into contact with each other.

According to the foregoing arrangement, the second cyclones 120 may be efficiently disposed within the first cyclone 110. In particular, the second cyclone 120 of the present disclosure does not have an additional guide passage that has been provided in the second cyclone in the related art, and thus a larger number of second cyclones 120 may be disposed within the first cyclone 110. Accordingly, even though it has a structure in which the second cyclone 120 is accommodated into the first cyclone 110, the number of the second cyclones 120 compared to the related art may not be reduced, thereby preventing the cleaning performance from being deteriorated.

The cover member 130 is disposed at an upper portion of the second cyclone 120. The cover member 130 is disposed to cover the inlet 120*a* of the second cyclone 120 at predetermined intervals to form a second space (S2) communicating with the first space (S1) between the inlet 120*a* and the cover member 130. The second space (S2) is formed to be extended in a horizontal direction on the second cyclone 120, and configured to communicate with the inlet 120*a* of the second cyclone 120.

According to the communication relationship, air introduced into the first cyclone 110 is introduced into the inlet 120*a* at an upper portion of the second cyclone 120 through the first space (S1) and second space (S2).

Referring to both FIGS. 4 and 6, a vortex finder 122 configured to discharge air from which fine dust has been separated is provided at the center of an upper portion of the second cyclone 120. Due to the upper structure, the inlet 120*a* may be defined as an annular space between an inner circumference of the second cyclone 120 and an outer circumference of the vortex finder 122.

A guide vane 123 extended in a spiral shape along an inner circumference is provided at the inlet 120*a* of the second cyclone 120. The guide vane 123 may be installed at an outer circumference of the vortex finder 122 or integrally formed with the vortex finder 122. Rotational flow is generated in air introduced into the second cyclone 120 through the inlet 120*a* by the guide vane 123.

Considering the flow of air and fine dust introduced into the inlet 120*a* in detail, the fine dust flows down while rotationally moving in a spiral shape along an inner circumference of the second cyclone 120, and is eventually discharged through the outlet 120*b* and collected in the fine dust storage portion (D2). Furthermore, relatively light air compared to fine dust is discharged to the vortex finder 122 at an upper portion thereof by suction power.

According to the foregoing structure, contrary to the related art in which high-speed rotational flow is generated while being biased to one side by the guide passage, relatively uniform rotational flow is generated over a substantially entire region. Accordingly, local high-speed flow is not generated compared to the structure of the second cyclone in the related art, thereby reducing the flow loss due to this.

A plurality of guide vanes 123 may be disposed to be separated at predetermined intervals along an outer circumference of the vortex finder 122. Each of the guide vanes 123 may be configured to be started from the same location at an upper portion of the vortex finder 122 and extended to the same location at a lower portion thereof.

According to the present drawing, four guide vanes 123 are disposed at 90° intervals along an outer circumference of the vortex finder 122. According to a design change, a larger number of the guide vanes 123 may be provided compared to the illustrated example, and at least part of any one guide vane 123 may be disposed to overlap with another guide vane 123 in a vertical direction of the vortex finder 122.

Furthermore, the guide vane 123 may be disposed within the first cyclone 110. According to the foregoing arrangement, flow within the second cyclone 120 may be generated within the first cyclone 110. Accordingly, it may be possible to reduce noise due to the flow within the second cyclone 120.

On the other hand, a lower diameter of the vortex finder 122 may be formed to be less than an upper diameter thereof. According to the foregoing shape, an area of the inlet 120*a* may be decreased to increase a speed of flowing into the second cyclone 120, and fine dust introduced into the second cyclone 120 may be limited from being discharged through the vortex finder 122 along with air.

According to the present drawing, it is illustrated that a taper portion 122*a* a diameter of which gradually decreases as being located at an end portion on the lower portion of the vortex finder 122. On the contrary, a diameter of the vortex finder 122 may be formed to gradually decrease as being located from the upper to the lower portion.

On the other hand, a communication hole 130*a* corresponding to the vortex finder 122 is formed on the cover member 130. The vortex finder 122 is inserted into the cover member 130, and a protrusion portion 131 in which the communication hole 130*a* is formed may be provided thereinside.

An upper cover 140 is disposed on the cover member 130 to form a discharge passage for discharging air discharged through the communication hole 130*a* to an outside of the dust collector 100. The exit 100*b* of the dust collector 100 is formed on the upper cover 140 to discharge air. The upper cover 140 may form an upper appearance of the dust collector 100. A knob 141 may be rotatably coupled to the upper cover 140.

Air discharged through the exit 100*b* of the dust collector 100 may be discharged through an exhaust port of the cleaner body 11 to an outside thereof. A porous prefilter (not shown) configured to filter out ultra-fine dust from air may be installed on a passage extended from the exit 100*b* of the dust collector 100 to the exhaust port of the cleaner body 11.

On the other hand, the outlet 120*b* of the second cyclone 120 is installed to pass through a bottom surface 111*d* of the first cyclone 110. A through hole 111*d*' for the insertion of the second cyclone 120 is formed on the bottom surface 111*d* of the first cyclone 110.

An inner case 150 accommodating the outlet 120*b* is installed at a lower portion of the first cyclone 110 to form the fine dust storage portion (D2) for collecting fine dust discharged through the outlet 120*b*. A lower cover 160 which will be described later forms a bottom surface of the fine dust storage portion (D2).

The inner case 150 may include a first portion 151 and a second portion 152.

The first portion 151 is disposed to cover the bottom surface 111*d* of the first cyclone 110, and configured to accommodate the outlet 120*b* of the second cyclone 120 therein. The first portion 151 is disposed on a pressurizing unit 170.

The second portion 152 is extended toward a lower portion of the outer case 101 from one side of the first portion 151. The second portion 152 may be disposed in parallel with one side of a rotating shaft 171 of the pressurizing unit 170. According to the foregoing structure, fine dust discharged through the outlet 120*b* is first collected into the second portion 152.

On the other hand, dust filtered out through the first cyclone 110 is collected into the dust storage portion (D1) between an inner circumference of the outer case 101 and an outer circumference of the inner case 150. The bottom surface of the dust storage portion (D1) may be formed by the lower cover 160 in the following.

Referring to FIG. 3, both the dust storage portion (D1) and fine dust storage portion (D2) are formed to be open toward a lower portion of the outer case 101. The lower cover 160 is coupled to the outer case 101 to cover an opening portion of the dust storage portion (D1) and fine dust storage portion (D2) so as to form a bottom surface of the dust storage portion (D1) and fine dust storage portion (D2).

As described above, the lower cover 160 is coupled to the outer case 101 to open or close a lower portion thereof. According to the present embodiment, it is illustrated that the lower cover 160 is coupled to the outer case 101 through a hinge 161 to open or close a lower portion of the outer case 101 according to the rotation thereof. However, the present disclosure may not be necessarily limited to this, and the lower cover 160 may be also coupled to the outer case 101 in a completely detachable manner.

The lower cover 160 is coupled to the outer case 101 to form a bottom surface of the dust storage portion (D1) and fine dust storage portion (D2). The lower cover 160 is rotated by the hinge 161 to discharge dust and fine dust at the same time so as to open the dust storage portion (D1) and fine dust storage portion (D2) at the same time. When the lower cover 160 is rotated by the hinge 161 to open the dust storage portion (D1) and fine dust storage portion (D2) at the same time, it may be possible to discharge dust and fine dust at the same time.

A partition plate 101*a* configured to form an upper wall of the dust storage portion (D1) may be provided within the outer case 101. The partition plate 101*a* has an opening portion 101*a*' extended along an inner circumference of the outer case 101 to introduce dust filtered out by the first cyclone 110 into a predetermined region of the dust storage portion (D1).

According to the arrangement, the partition plate 101*a* is located below the skirt 111*c*, and disposed within an annular space between the outer case 101 and the inner case 150.

On the other hand, if accumulated dust is dispersed without being gathered at one place, there is a possibility that dust can be scattered or discharged to an unintentional place during the process of discharging dust. The present disclosure is configured to pressurize dust collected in the dust storage portion (D1) using the pressurizing unit 170 to reduce the volume thereof to overcome the foregoing problem.

The pressurizing unit 170 is configured to be rotatable in both directions within the dust storage portion (D1). The pressurizing unit 170 may include a rotating shaft 171, a pressurizing member 172 and a stationary portion 173.

The rotating shaft 171 is disposed below the first portion 151 of the inner case 150. The rotating shaft 171 is configured to receive power from a driving motor of the cleaner body 11 to be rotatable. The rotating shaft 171 is configured to be rotatable in a clockwise or counter-clockwise direction, namely, in both directions.

A groove 171*a* recessed in an inward direction is formed at an upper portion of the rotating shaft 171, and a protrusion 151*a* inserted into the groove 171*a* to support the rotation of the rotating shaft 171 may be formed in a protruding manner at a lower portion of the first portion 151 of the inner case 150. According to the foregoing structure, the protrusion 151*a* inserted into the groove 171*a* is configured to hold the rotational center of the rotating shaft 171 while the rotating shaft 171 is rotated. Accordingly, the rotation of the rotating shaft 171 may be more stably carried out.

The pressurizing member 172 is connected to the rotating shaft 171 to rotate within the dust storage portion (D1) according to the rotation of the rotating shaft 171. The pressurizing member 172 may be formed in a plate shape. Dust collected into the dust storage portion (D1) is moved and collected to one side of the dust storage portion (D1) by the rotation of the pressurizing member 172, and when a lot of dust is accumulated, the dust is pressurized and compressed by the pressurizing member 172.

An inner wall 101*b* for collecting dust that has been moved to the one side by the rotation of the pressurizing member 172 may be provided within the dust storage portion (D1). According to the present embodiment, it is shown that the inner wall 101*b* is disposed at an opposite side to the rotating shaft 171 by interposing the second portion 152 of the inner case 150 therebetween. Accordingly this, dust introduced into the dust storage portion (D1) is collected to both sides of the inner wall 101*b*, respectively, by the rotation of the pressurizing member 172.

The inner wall 101*b* may be formed in a protruding manner on an inner circumference of the outer case 101, and formed integrally with the partition plate 101*a* at an upper portion of the inner wall 101*b*.

The stationary portion 173 is coupled to the rotating shaft 171 in a relatively rotatable manner, and fixed to the second portion 152 of the inner case 150. Since the stationary portion 173 is coupled to the inner case 150, the pressurizing member 172 and rotating shaft 171 may be fixed in place even though the lower cover 160 is rotated by the hinge 161 to open the dust storage portion (D1).

A lower end portion of the pressurizing unit 170 is configured to pass through the lower cover 160 to be exposed to an outside of the dust collector 100. As illustrated in the drawing, when the lower cover 160 is coupled to the outer case 101, a driven gear 174 configured to be engaged with the rotating shaft 171 may be installed on the lower cover 160. The driven gear 174 is configured to be relatively rotatable with respect to the lower cover 160. When the dust collector 100 is coupled to the cleaner body 11 (refer to FIG. 1), the driven gear 174 is engaged with the driving gear (not shown) of the cleaner body 11 to transfer a driving force of the driving portion (not shown) to the rotating shaft 171.

Of course, the structure of transferring a driving force of the driving portion to the rotating shaft 171 may be changed. For example, the rotating shaft 171 may be disposed to pass through the lower cover 160 to be directly engaged with the driving gear of the driving portion.

Based on any one structure of them, a lower end portion of the pressurizing unit 170 should be configured to be relatively rotatable with respect to the lower cover 160. A sealing member configured to seal between them may be provided at a relatively rotating portion on the lower cover 160

When the dust collector 100 is coupled to the cleaner body 11, the pressurizing unit 170 is configured to be connected to a driving gear of the cleaner body 11. The driving gear receives a driving force from the driving portion of the cleaner body 11. The driving portion of the cleaner body 11 may include a driving motor (not shown). The driving motor is distinguished from the foregoing suction motor.

A driving force transferred to the driving gear of the cleaner body 11 is transferred to the pressurizing unit 170. The driven gear 174 is rotated by a driving force transferred through the driving gear, and thus the rotating shaft 171 and pressurizing member 172 are also rotated at the same time.

At this time, the rotation of the driving motor may be controlled to repeatedly generate a bi-directional rotation of the pressurizing member 172. For example, it may be configured such that when a repulsive force is applied in an opposite direction to the rotation direction, the driving motor rotates in an opposite direction. In other words, it is configured such that when the pressurizing member 172 rotates in one direction to compress dust collected at one side to a certain level, the driving motor rotates in the other direction to compress dust collected at the other side.

It may be also configured such that when there is no (little) dust, the pressurizing member 172 collides the inner wall 101*b* to receive the resultant repulsive force or receive a repulsive force due to a stopper structure (not shown) provided on a rotational path of the pressurizing member 172 to be rotated in an opposite direction.

On the contrary, the controller within the cleaner body 11 may apply a control signal to the driving motor to change a rotational direction of the pressurizing member 172 at each predetermined time, thereby repeatedly generating a bi-directional rotation of the pressurizing member 172.

Due to the foregoing pressurizing unit 170, it may be possible to suppress the scattering of dust and significantly reduce a possibility of discharging dust to an unintentional place during the process of discharging dust.

The invention claimed is:

1. A dust collector for a vacuum cleaner, comprising:

a first cyclone installed within an outer case to filter out dust from air inhaled from an outside thereof and to introduce the air from which dust has been filtered out into an inside thereof;

a plurality of second cyclones accommodated in the inside of the first cyclone to separate fine dust from the air introduced to the inside of the first cyclone;

a cover member disposed to cover an inlet of the plurality of second cyclones; and a lid disposed above the cover member on an opposite side of the cover member from the inlet, the lid covering the cover member, wherein a first space is formed outside of the second cyclones and within the first cyclone, and the cover member forms a second space communicating with the first space between the inlet and the cover member, wherein a plurality of guide vanes extend in a spiral shape along an inner circumference of each of the plurality of second cyclones, the plurality of guide vanes being provided at the inlet to induce rotational flow of air introduced to an inside of each of the plurality of second cyclones through the first and the second space, wherein the plurality of guide vanes are arranged in a circumferential direction within the plurality of second cyclones, and at least a portion of a first guide vane of the plurality of guide vanes overlaps with a second guide vane of the plurality of guide vanes in a vertical direction, wherein the inlet of each of the plurality of second cyclones has four air introduction ports between the plurality of guide vanes in the plurality of second cyclones, wherein a casing of the plurality of second cyclones is located within the first cyclone such that a top of the casing does not extend past a top of the first cyclone, and the plurality of guide vanes are located below the top of the first cyclone and within each of the plurality of second cyclones, wherein the plurality of second cyclones include:

a plurality of outer second cyclones arranged along an inner circumference surface of the first cyclone; and an inner second cyclone placed at a center portion of the first cyclone and surrounded by the plurality of outer second cyclones, wherein an outer circumferential surface of each of the plurality of outer second cyclones is disposed between the inner circumference surface of the first cyclone and an outer circumference surface of the inner second cyclone to be in contact with the inner circumference surface of the first cyclone and the outer circumference surface of the inner second cyclone, wherein the plurality of outer second cyclones and the inner second cyclone are formed in one body, wherein the cover member is positioned to be spaced apart from and upward from a top of the plurality of second cyclones, and the second space is positioned between the cover member and the top of the plurality of second cyclones, and wherein a top of the plurality of guide vanes is positioned below the top of the plurality of second cyclones to guide air flow downward from the second space.

2. A dust collector for a vacuum cleaner of claim 1, wherein the plurality of second cyclones are formed such that cyclones disposed adjacent to each other are connected to each other to form an integral body.

3. A dust collector for a vacuum cleaner of claim 1, wherein a vortex finder for discharging air from which fine dust has been separated is provided at the center of each of the plurality of second cyclones, and the plurality of guide vanes are installed on the inlet limited between an inner circumference of each of the plurality of second cyclones and an outer circumference of the vortex finder.

4. A dust collector for a vacuum cleaner of claim 3, wherein the plurality of guide vanes are disposed within the first cyclone.

5. A dust collector for a vacuum cleaner of claim 3, wherein the plurality of guide vanes are disposed at predetermined intervals in a separate manner along an outer circumference of the vortex finder.

6. A dust collector for a vacuum cleaner of claim 3, wherein the cover member comprises a communication hole corresponding to the vortex finder, and an upper cover is disposed on the cover member to form a discharge passage so as to discharge air discharged through the communication hole to an outside of the dust collector.

7. A dust collector for a vacuum cleaner of claim 6, wherein a protrusion portion inserted into the vortex finder and provided with the communication hole therein is formed on the cover member.

8. A dust collector for a vacuum cleaner of claim 1, wherein an outlet of each of the plurality of second cyclones is installed to pass through a bottom surface of the first cyclone, an inner case for accommodating the outlet is installed at a lower portion of the first cyclone to form a fine dust storage portion for collecting fine dust discharged through the outlet; and dust filtered out through the first cyclone is collected into a dust storage portion between an inner circumference of the outer case and an outer circumference of the inner case.

9. A dust collector for a vacuum cleaner of claim 8, further comprising:

a lower cover hinge-coupled to the outer case to form a bottom surface of the dust storage portion and the fine dust storage portion, and rotated by the hinge to open the dust storage portion and the fine dust storage portion at the same time so as to discharge the dust and the fine dust at the same time.

10. A dust collector for a vacuum cleaner of claim 9, further comprising:

a pressurizing unit configured to be rotatable in both directions within the dust storage portion so as to pressurize dust collected in the dust storage portion to reduce the volume of dust in the dust storage portion, wherein the pressurizing unit comprises:

a rotating shaft;

a pressurizing member connected to the rotating shaft to be rotatable within the dust storage portion; and a stationary portion formed to be relatively rotatable with respect to the rotating shaft, and coupled to the inner case.

11. A dust collector for a vacuum cleaner of claim 10, wherein a lower end portion of the pressuring unit is configured to be engaged with a driving gear of a cleaner body when the dust collector is coupled to the cleaner body through the lower cover portion to be exposed to an outside of the dust collector.

12. A dust collector for a vacuum cleaner of claim 10, wherein the inner case comprises:

a first portion formed to accommodate the outlet of each of the plurality of second cyclones; and a second portion extended downward from one side of a bottom surface of the first portion to form a fine dust storage portion that stores fine dust discharged through the outlet, the second portion being eccentrically arranged to be spaced radially away from the rotating shaft, and wherein a groove recessed in an inward direction is formed at an upper portion of the rotating shaft, and a protrusion inserted into the groove to support the rotation of the rotating shaft is formed in a protruding manner at a lower portion of the first portion.

13. A dust collector for a vacuum cleaner of claim 8, wherein a skirt is formed in a protruding manner at a lower portion of the first cyclone along an outer circumferential surface to prevent the scattering of dust collected into the dust storage portion.

14. A dust collector for a vacuum cleaner of claim 8, wherein a partition plate at one portion of which is open is installed between the outer case and the inner case to form an upper wall of the dust storage portion and introduce dust filtered out by the first cyclone to a predetermined region of the dust storage portion.

15. A dust collector for a vacuum cleaner, comprising:

an outer case having an entrance;

a first cyclone installed at an inside of the outer case, and provided with a mesh filter covering an opening portion communicating with the inside at an outer circumference thereof;

a plurality of second cyclones accommodated into the first cyclone, and provided with a vortex finder provided at an inlet side and a plurality of guide vanes extended in a spiral shape to an outlet side from the inlet side of each of the plurality of second cyclones;

a cover member disposed to cover the plurality of second cyclones, and provided with a communication hole corresponding to the vortex finder; and a lid disposed above the cover member on an opposite side of the cover member from the inlet, the lid covering the cover member, wherein air introduced from outside the first cyclone is introduced into the first cyclone in a state that dust is filtered out by the mesh filter, air introduced into the first cyclone is introduced into the plurality of second cyclones in a state that rotational flow is induced by the plurality of guide vanes to discharge fine dust through the outlet side, and discharge air from which fine dust has been filtered out onto the cover member through the vortex finder, a casing of the plurality of second cyclones is located within the first cyclone such that a top of the casing does not extend past a top of the first cyclone, and the plurality of guide vanes are located below the top of the first cyclone and within each of the plurality of second cyclones, wherein the plurality of guide vanes are arranged in a circumferential direction within the plurality of second cyclones, and at least a portion of a first guide vane of the plurality of guide vanes overlaps with a second guide vane of the plurality of guide vanes in a vertical direction, wherein the inlet of each of the plurality of second cyclones has four air introduction ports between the plurality of guide vanes in the plurality of second cyclones, wherein the plurality of second cyclones include:

at least one inner second cyclone positioned within the first cyclone; and a plurality of outer second cyclones surrounding the at least one inner second cyclone and positioned between at least one inner second cyclone and an inner circumference surface of the first cyclone, and wherein an outer circumferential surface of each of the plurality of outer second cyclones contacts the inner circumference surface of the first cyclone and an outer circumference surface of the at least one inner second cyclone, wherein the at least one inner second cyclone and the plurality of outer second cyclones are integrally formed, wherein the cover member is spaced apart from and upward from a top of the plurality of second cyclones, and a space is provided between the cover member and the top of the plurality of second cyclones, and wherein a top of the plurality of guide vanes is provided below the top of the plurality of second cyclones to guide air flow downward from the space.

16. A dust collector for a vacuum cleaner of claim 15, wherein an upper cover is disposed on the cover member to form a discharge passage for discharging air from which fine dust has been filtered out to the outside.

17. A dust collector for a vacuum cleaner of claim 15, wherein an outlet of the plurality of second cyclones is installed to pass through a bottom surface of the first cyclone, and an inner case for accommodating the outlet is installed at a lower portion of the first cyclone to form a fine dust storage portion for collecting fine dust discharged through the outlet.

18. A dust collector for a vacuum cleaner of claim 17, wherein dust filtered out through the first cyclone is collected into a dust storage portion between an inner circumference of the outer case and an outer circumference of the inner case.

19. A dust collector for a vacuum cleaner of claim 18, further comprising:

a partition plate that includes an open portion, wherein the partition plate extends radially across an annular space between the outer case and the first cyclone to partition the annular space and the dust storage unit, and the partition plate introduces dust filtered out by the first cyclone through the open portion to a predetermined region of the dust storage portion.

20. A dust collector for a vacuum cleaner of claim 15, wherein the outer circumferential surface of one of the plurality of outer second cyclones further contacts the outer circumferential surfaces of another one of the plurality of outer second cyclones.

* * * * *